US006820723B2

(12) United States Patent
Huber

(10) Patent No.: US 6,820,723 B2
(45) Date of Patent: Nov. 23, 2004

(54) ADAPTER FOR CONNECTION BETWEEN VEHICLE AND LADDER

(76) Inventor: Ronald L. Huber, 8717 Dal-Mar Dr., North, Brainerd, MN (US) 56401

( * ) Notice: Subject to any disclaimer, the term of this patent is extended or adjusted under 35 U.S.C. 154(b) by 0 days.

(21) Appl. No.: 10/289,966

(22) Filed: Nov. 7, 2002

(65) Prior Publication Data

US 2003/0057021 A1 Mar. 27, 2003

Related U.S. Application Data

(63) Continuation-in-part of application No. 09/851,855, filed on May 9, 2001, now abandoned.

(51) Int. Cl.[7] ..... E06C 5/00
(52) U.S. Cl. ..... 182/127; 182/68.1
(58) Field of Search ..... 182/127, 68.1, 182/90, 92, 93, 88, 150, 41, 68, 97, 222, 223, 119, 207; 280/165, 166, 163, 492–494

(56) References Cited

U.S. PATENT DOCUMENTS 2,586,531 A * 2/1952 Gordon ..... 182/127
3,123,178 A * 3/1964 Monaghan et al. ..... 182/97
3,718,315 A 2/1973 Huber
3,882,964 A * 5/1975 Schellenberg ..... 182/69.4
4,155,537 A 5/1979 Bronson et al.
4,408,680 A * 10/1983 Ross ..... 182/68.1
4,607,991 A 8/1986 Porter
4,812,093 A 3/1989 Millar, Jr.
4,858,725 A * 8/1989 Griffin ..... 182/127
5,295,555 A * 3/1994 Strange ..... 182/2.5
5,469,933 A * 11/1995 Thomason ..... 182/127
6,357,548 B1 * 3/2002 Boyd ..... 182/127

* cited by examiner

*Primary Examiner*—Hugh B. Thompson, II

(57) ABSTRACT

An adapter to permit a ladder to placed in an operating position on a vehicle, wherein the vehicle acts as a base for the ladder. The adapter is engaged to the hitch of the vehicle. The adapter includes a first removable shaft that is slid through a tubular rung at the bottom of the ladder. The adapter includes peripheral devices. One peripheral device is a tether that is engaged between the vehicle and the upper end of the ladder. The tether includes a ratchet mechanism for shortening and lengthening the tether and for changing an angle of the ladder relative to the ground. Another peripheral device is a second removable shaft for being slid through an upper rung of the ladder and for being engaged by the tether. Still another peripheral device is a leg for being placed between the adapter and the ground to minimize the chances of the front end of the vehicle from being raised when a user is on the upper end of the ladder and when the ladder has been extended.

14 Claims, 14 Drawing Sheets

50
42
50
20
10
38
28
30
40
48
28
46
32
116
26
34
24
112
110

36
44
38
28
58
20
56
26
34
54
59
32

66
62
64
66
62
64
60
18
14
60

94
80
80
22

74
80
72
78
76
88
94
82
84
68
92
90
72
84
86
82
70
68
92
90
88
82
86
70
66
62
62
82
66
64
64

100
96
76
74
96
108
12
104
106
106
96
38
102
98

128
138
134
132
150
138
136
151
148
130
138
132
140
142
146
144
154
152

ADAPTER FOR CONNECTION BETWEEN VEHICLE AND LADDER

This application is a continuation-in-part of, and claims the benefit under 35 U.S.C. §120 of, my U.S. patent application Ser. No. 09/851,855 filed May 9, 2001 now abandoned which is hereby incorporated by reference in its entirety into this application.

FIELD OF THE INVENTION

The present invention relates generally to an adapter for connection between a vehicle and a ladder such that the vehicle acts as a base for placing the ladder in an operating position and, more specifically, relates to an adapter that is engaged to the hitch of the vehicle.

BACKGROUND OF THE INVENTION

An overhanging branch that includes dead wood that should be cut is an example of a problem. One may choose to use an extension ladder and prop the upper end of the extension ladder against the overhanging branch, yet the overhanging branch may be dead and brittle itself. Or the upper end of the extension ladder may barely reach the overhanging branch, which may swing to and from with the wind. Or the ground on which the bottom end of the ladder is placed may be wet with the dew, or may slope away from the trunk of the tree.

An overhanging branch is an example of an object that is placed "in the middle of nowhere," but there are problems placing ladders against structures such as houses. The upper ends of ladders may break windows. Ladders themselves may fall into picture windows that look out from living and dining rooms. Ladders crush gutters. Ladders catch on electrical wires or cables running into the house. These examples illustrate but a few of the problems using the exterior of a house as a functional support for a ladder.

SUMMARY OF THE INVENTION

A feature of the present invention is the utilization of a vehicle as a base for a ladder in a functional position.

Another feature of the present invention is an adapter for connection between a vehicle and a ladder such that the vehicle is used as a base for the ladder that is placed in an operating position.

Another feature of the present invention is the provision in such an adapter, of a hitch connection to permit the adapter to be connected to the hitch of the vehicle.

Another feature of the present invention is the provision in such an adapter, of a removable first shaft, wherein the first shaft may be partially removed from the adapter, slid through the tubular bottom rung of a ladder, and then engaged again with the adapter to fix a bottom end of the ladder to the adapter.

Another feature of the present invention is a tether for engaging the upper end of the ladder to the vehicle. The tether may be connected directly to an upper portion of the ladder or connected to a second shaft that has been slid through an upper tubular rung of the ladder. The tether may include ratchet mechanisms to lengthen or shorten the tether so as to change the angle of the ladder relative to the ground.

Another feature of the present invention is a leg for the adapter. The leg extends downwardly from the adapter to the ground. The leg supports and holds up the rear end of the vehicle and thereby holds down the front end of the vehicle when a person is on the upper (perhaps extended) end of the ladder. The weight of such a person acts as a force that tends to raise the front end of the vehicle.

Another feature of the present invention is an oblique plate mounted on the adapter so as to minimize the chances of the bottom end of the ladder swinging in a first direction away from the base portion of the adapter. Swinging of the bottom end of the ladder in the second direction is permitted, as such swinging is controlled by the shortening and lengthening of the tether that controls the angle of the ladder relative to the ground.

An advantage of the invention is safety. A vehicle, not a overhanging branch or the decorative or dangerous exterior of a house, serves as a base for a ladder. A vehicle, even a compact car, is relatively heavy and is therefore relatively safe. The ladder, when fixed to a vehicle through the adapter, is relatively sturdy.

Another advantage of the invention is cost. The present invention is relatively inexpensive to manufacture.

Another advantage is simplicity. The present invention is relatively easy to manufacture and simple to use. With the present adapter, a ladder is easy to put up, easy to adjust, easy to climb, and easy to take down.

Another advantage is one man use. The user of the ladder and adapter can set up, climb, and take down the ladder by himself or herself. No other person is required to hold the ladder.

Another advantage is speed. The adapter is engageable quickly to the hitch, the ladder is engageable quickly to the adapter, the tether may be fastened quickly to the truck and upper end of the ladder, and the leg is quickly slideable into the adapter. Further, the tether may be quickly shortened or lengthened through the ratchet mechanism, and the leg may be quickly telescopically adjusted to reach the ground. Still further, an extension ladder may be quickly extended or retracted even though fixed to the adapter.

Another advantage is that the adapter and its peripheral equipment, such as the tether and leg peripherals, are compact for storage.

DESCRIPTION

Figure 1:
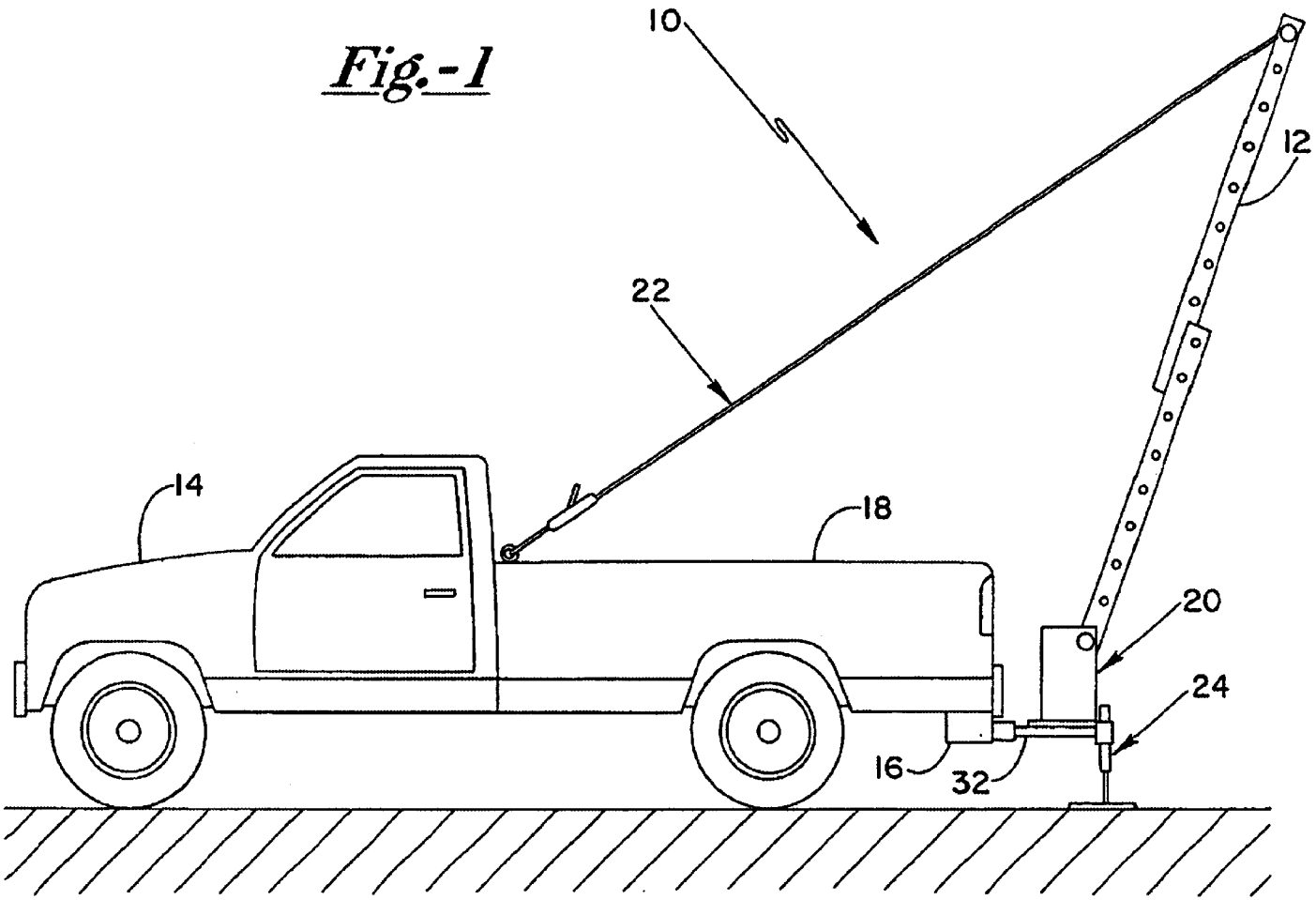
FIG. 1 is an environmental view showing the adapter connected between a pickup truck and a ladder placed in an operating position.

As shown in FIG. 1, an adapter kit is indicated generally by reference number 10. The adapter kit 10 is utilized to fix a ladder 12 in an operating position to a vehicle 14. The vehicle 14 is a pickup truck and includes a conventional tubular hitch 16. The hitch 16 is situated at the rear of the vehicle 14 below the bed 18 of the truck 14. The hitch 16 is rigidly fixed to the frame of the truck 14.

As further shown in FIG. 1, adapter kit 10 generally includes an adapter 20 removably engaged to the hitch 16 of the truck 14, a tether mechanism 22 for extending between the truck 14 and an upper end of the ladder 12, and a leg 24 for supporting the adapter 20 relative to the ground to minimize chances of the front end of the truck 14 being raised by the weight of a person on the upper end of the ladder.

Figure 2:
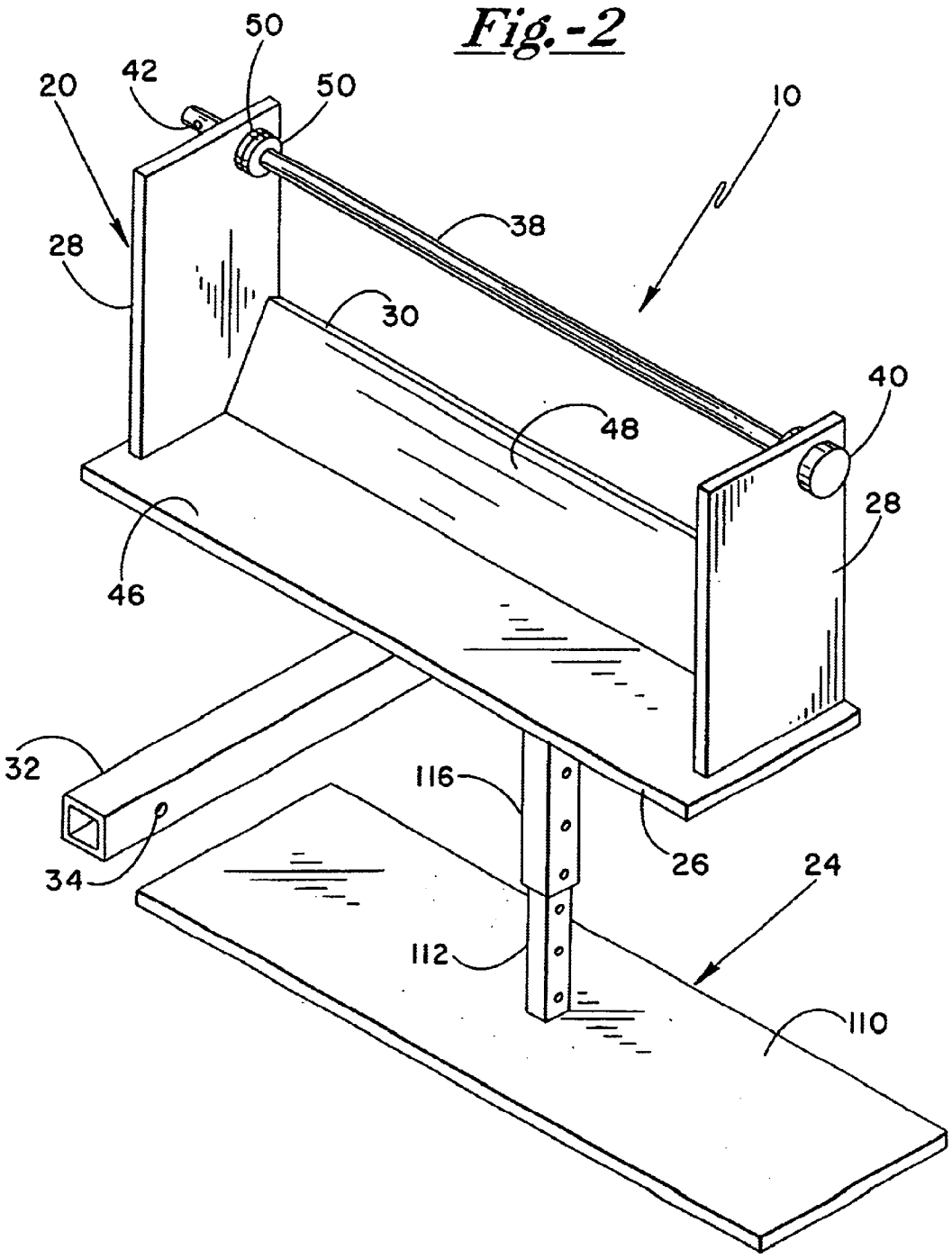
FIG. 2 is a perspective view of the adapter of FIG. 1.

More specifically, as shown in FIG. 2, the adapter 20 includes a rectangular base plate 26 on which are rigidly affixed, such as by welding, a pair of upright support plates 28. A transversely extending stop plate 30 is rigidly fixed, such as by welding, to an upper face of the base plate 26 and to and between the upright support plates 28. Transversely extending stop plate 30, together with base plate 26, fixes the upright support plates 28 rigidly. A rigid tubular beam 32 is fixed, such as by welding, to a lower face of the base plate 26. The tubular beam 32 includes an aperture 34 running through two walls of the beam 32. Beam 32 is sized so as to slide into the tubular hitch 16. Aperture 34 is then aligned with an aperture in the truck's hitch 16 and a pin is then inserted through the aligned apertures so as to fix the adapter 20 to the hitch 16. Each of the upright support plates 28 have openings 36 (shown in FIG. 6) for receiving a removable shaft 38. Removable shaft 38 includes a cap 40 rigidly fixed thereto for preventing the shaft 38 from being slid in one direction off its respective upright support plate. Removable shaft 38 includes on its other end, the end opposite of the fixed cap 40, an aperture 42 (shown in FIG. 3) for receiving a removable pin 44 (shown in FIG. 6). When engaged in the aperture 42, removable pin 44 prevents the removable shaft 38 from being slid off of the upright support plates 28. Removable shaft 38 is slid through a tubular bottom rung of ladder 12. The feet of the ladder 12 may rest upon an upper face portion 46 of base plate 26 or may rest upon a face portion 48 of oblique plate 30. A swinging of the feet or lower portion of the ladder 12 in one direction is prevented by the oblique plate 30. Plate 30 is mounted obliquely relative to the base plate 26 because the ladder 12 is generally set relatively parallel to oblique plate 48. Further, the oblique plate 30 is positioned immediately underneath of the shaft 38 to accommodate the thickness of the ladder 12 and to discourage the ladder 12 from being set up perpendicular to the ground. A swinging of the feet or lower portion of the ladder 12 in the other direction, i.e., away from the face portions 46 and 48 is permitted. This swinging is controlled by the tether mechanism 22.

Figure 3:
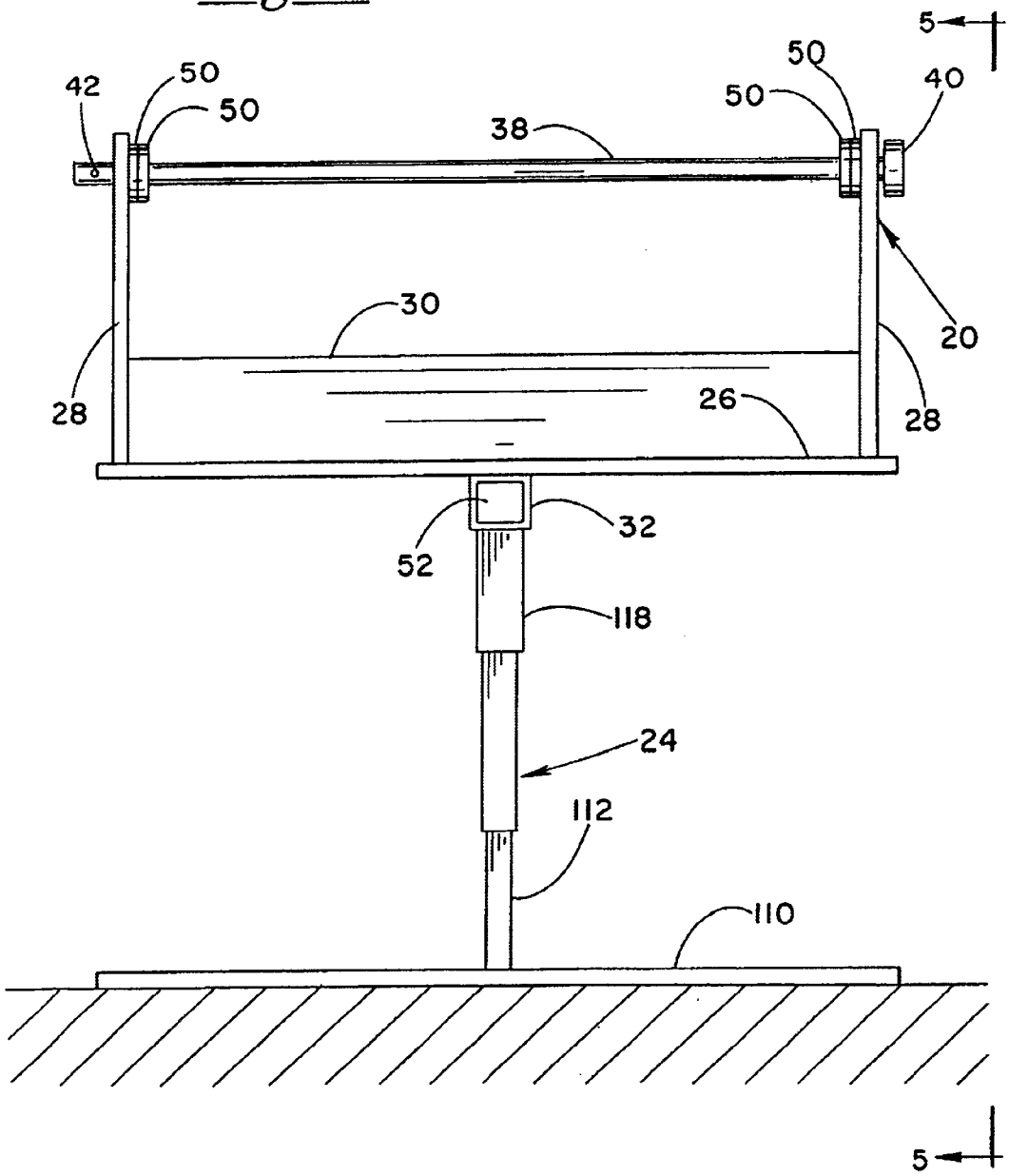
FIG. 3 is a front view of the adapter of FIG. 2.

FIG. 3 shows a front view of the adapter 20, i.e., the face of the adapter 20 closest to the hitch 16 of the truck 14. As can be noted, the tubular beam 34 is square in section. The tubular hitch 16 is also square in section. The outer faces of the beam 34 confront the inner faces of the hitch 16 so as to prevent rotation or spinning of the adapter 20 relative to the truck 14. Further, the leg 24 assists in preventing a rotation or spinning of the adapter 20 relative to the truck 14 along beam 34. As can be further noted, beam 34 is fixed at the center of the base 26 and is equidistant from each of the upright support plates 28 such that the adapter 20 is well balanced. Further, FIG. 3 shows relatively thick washers 50 removably mounted on shaft 38 to accommodate ladders 12 of different widths and to mount ladder 12 centrally on base plate 26 and equidistant from each of the upright support plates 28 such that the ladder 12 is centered over beam 34 and over hitch 16 and therefore centrally relative to truck 14. With washers 50, transverse movement of the ladder 12 on shaft 38 is minimized as the washers 50 have a size greater than the inner dimension of the tubular rung of ladder 12. Further, it can be appreciated that upright support plates 28 are set in equidistant from the ends of the base plate 26 so as to keep the adapter 20, which may be relatively heavy, well balanced.

Figure 4:
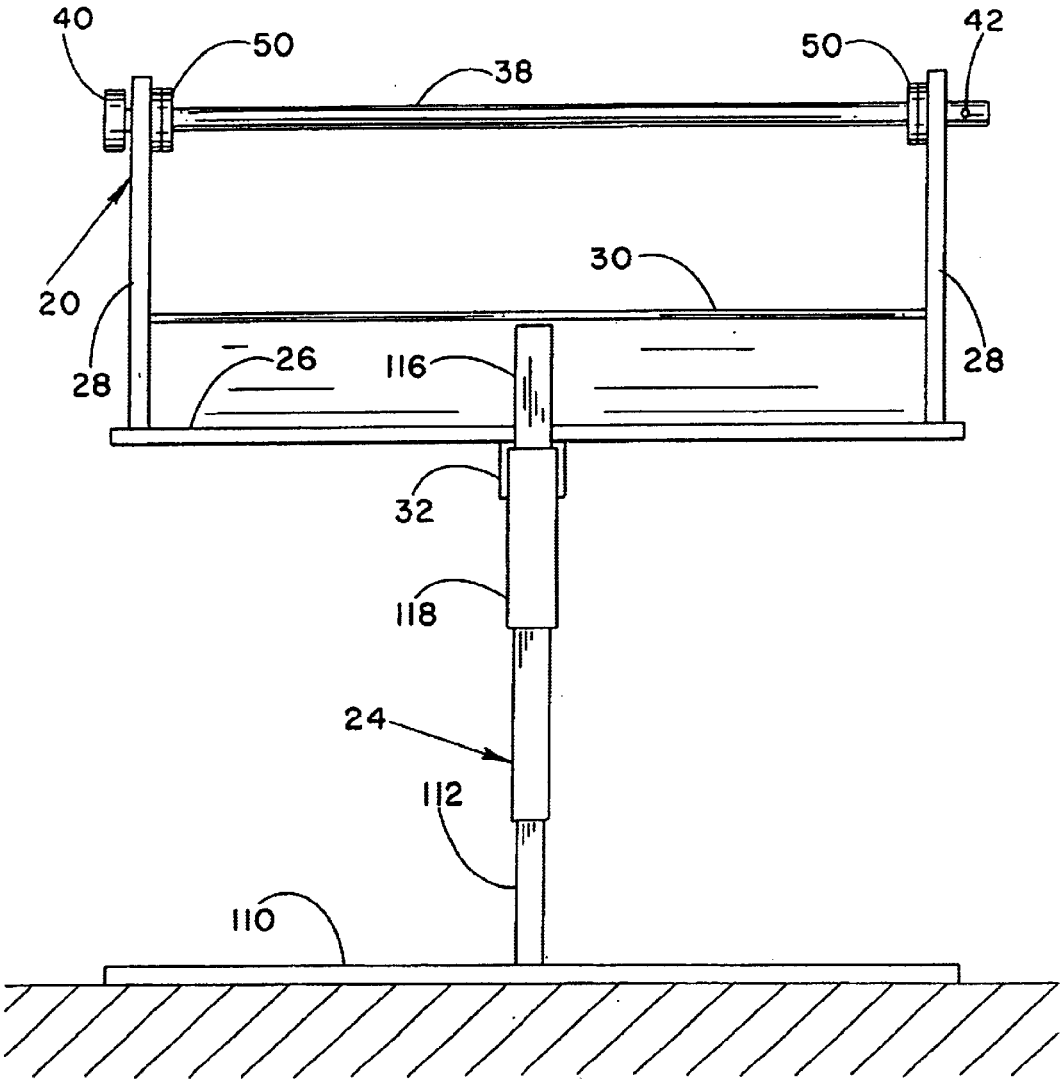
FIG. 4 is a rear view of the adapter of FIG. 2.

FIG. 4 shows the rear face of the adapter 20, i.e., the face of the adapter 20 that is closest to the leg 24. The beam 34 includes an opening 52 (shown in FIG. 3) for engagement with the leg 24. Opening 52 is square in section.

Figure 5:
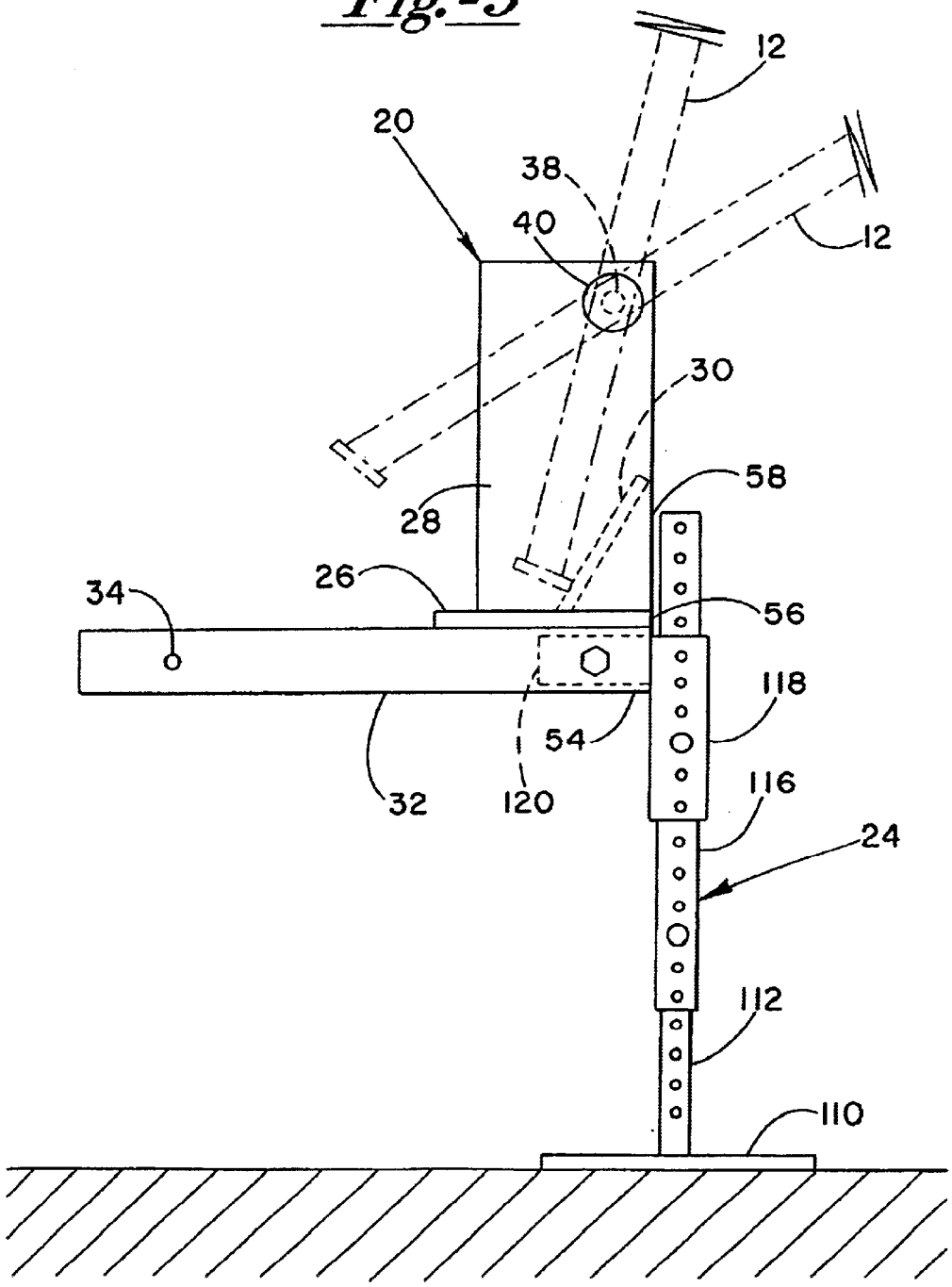
FIG. 5 is a side view of the adapter of FIG. 2 and further shows in phantom several operating positions for the ladder.
Figure 6:
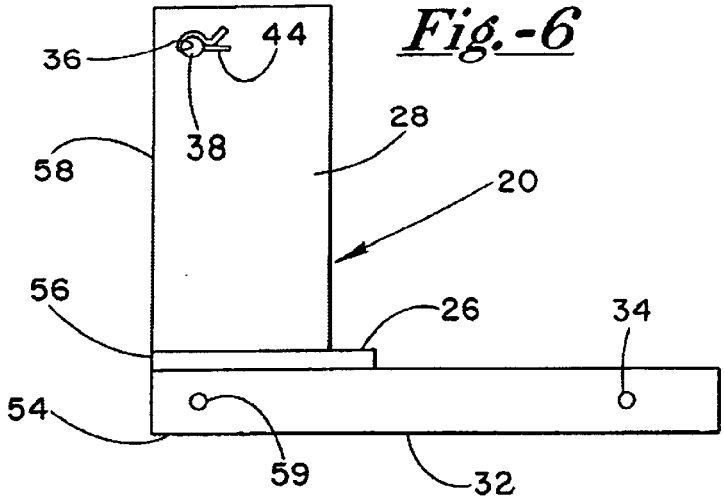
FIG. 6 is a side view of the adapter of FIG. 2.

FIG. 5 is a side view of the end of the adapter 20 having the cap 40, and FIG. 6 is a side view of the end of the adapter 20 having the pin 44. FIGS. 5 and 6 show the position of the shaft 38 (welded to the cap 40) relative to the oblique stop plate 30. FIGS. 5 and 6 further show that the beam 32 is relatively long to provide an relatively long elongate connection between the hitch 16 and the adapter 20. Beam 32 is further sufficiently long to extend across the full width of the base plate 26 and the entire width of the support plates 28. A rear end 54 of the beam 32 terminates at the rear edges 56 and 58 of the base plate 26 and upright support plates 28, respectively, so as to permit leg 24, a portion of which slides into beam end 54, to be fixed as directly as possible under upright plates 28 and the bottom end of the ladder 12. FIGS. 5 and 6 further show an aperture 59 in beam end 54 for being aligned with an aperture in leg 24. A pin inserted in such aligned apertures fixes the adapter 20 to leg 24.

FIG. 5 further shows how the ladder 12 can be pivotably placed in a multiple number of positions relative to the adapter 20. Stop plate 30 prevents the bottom end of the ladder 12 from swinging in a first direction relative to the adapter 20. Swinging of the bottom end of the ladder 12 in a second direction (opposite of the first direction) is controlled by the tether 22.

Figure 7:
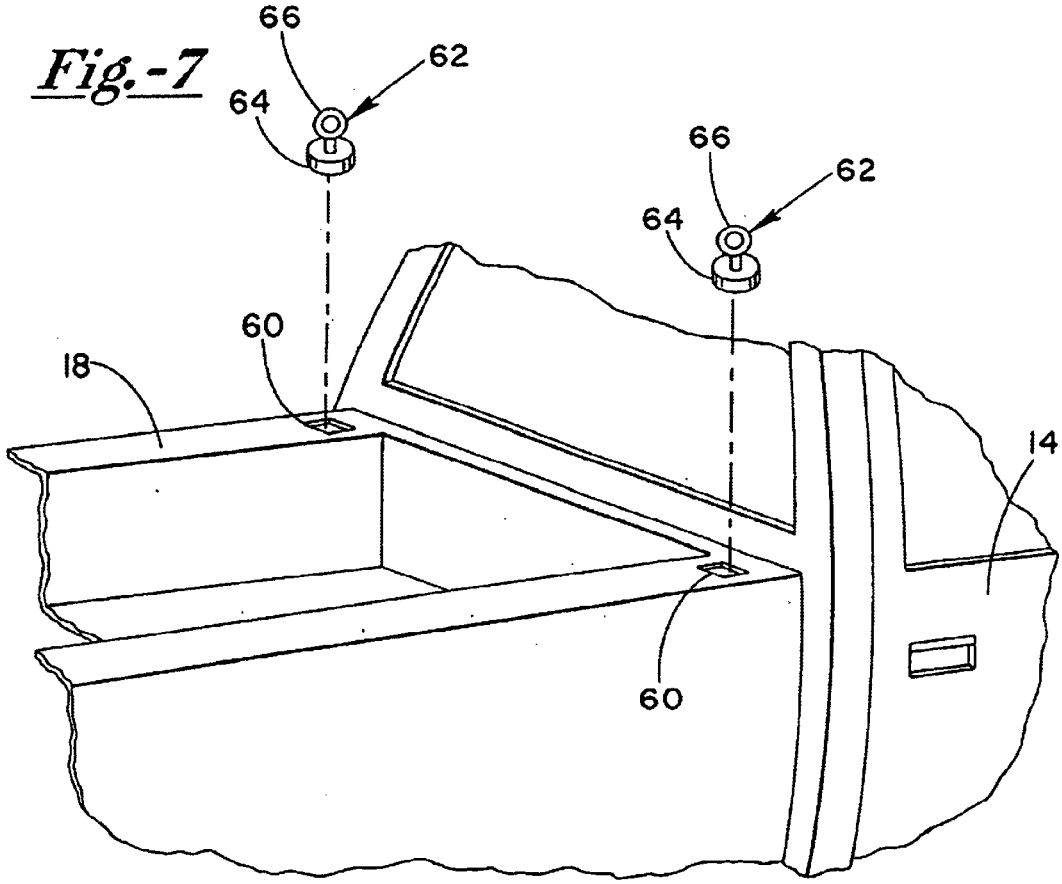
FIG. 7 is a perspective view of an adapter peripheral for the adapter of FIG. 2, wherein the adapter peripheral is engageable to a pickup truck.

FIG. 7 is a perspective view of a portion of the bed 18 of the truck 14 and a portion of the cab of the truck 14. The bed 18 of the truck 14 includes vehicle eyelets 60 on either side of the bed 18 for receiving pins 62. Pins 62 are part of the tether mechanism 22. Each of the pins 62 includes a catch 64 and a pin eyelet 66. Catch 64 may be biased to an open position away from the post of the pin 62 so as to keep the pin 62 anchored in the vehicle eyelet 60. Pin 62 may be removed from vehicle eyelet 60 by pinching the catch 64 and the post of pin 62 together.

Figure 8:
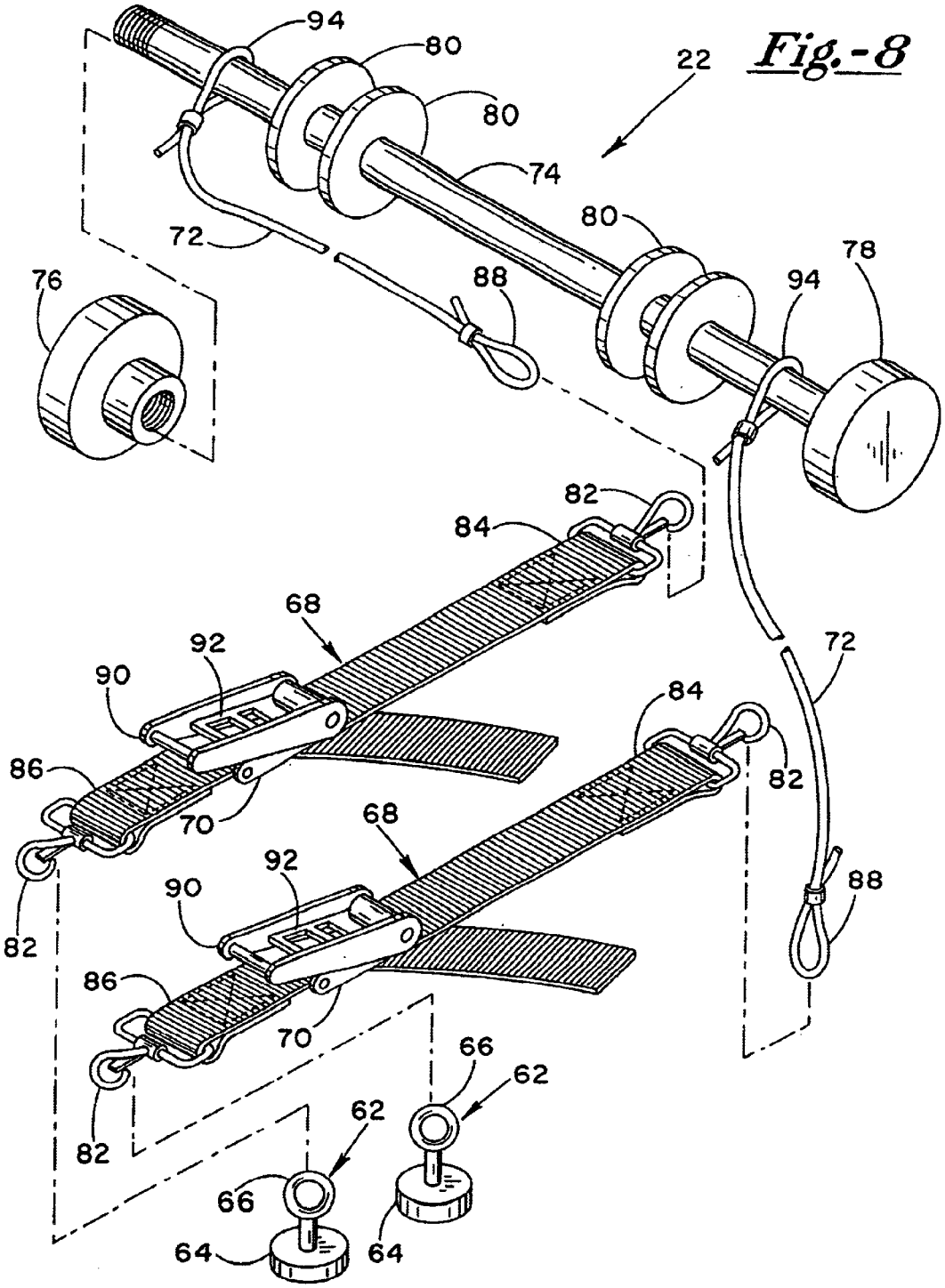
FIG. 8 is a perspective view of adapter peripherals for the adapter of FIG. 2.

FIG. 8 is a perspective view of the tether mechanism 22. Tether mechanism or extendable member 22 includes the pair of pins 62, a pair of tethers 68 with each of the tethers 68 having a ratchet mechanism 70, a pair of tether portions 72, and a second removable shaft 74 having removable end cap 76, fixed end cap 78 and washers 80. More specifically, tether 68 includes a spring loaded quick connector or clip 82 at each of its ends 84, 86. Clip 82 easily clips to and from pin eyelet 62 and easily clips to and from a loop 88 of tether portion 72. Ratchet mechanism 70 permits the tether 68 to be lengthened and shortened incrementally. A first lever 90 of the ratchet mechanism 70 winds up the strap of the tether 68 incrementally so as to shorten the tether 68. A second lever 92 of the ratchet mechanism 70 releases internal locks of the ratchet mechanism 70 so as to permit the strap of the tether 68 to be let out incrementally so as to lengthen the tether 68. Ratchet mechanism 70 is automatically biased toward a locked position such that, when either of the levers 90 or 92 is released, the lengthening or shortening of the strap of the tether 68 ceases. Tether portion 72 includes the loop 88 and further includes a loop 94 for engaging the second removable shaft 74. Loops 94 are engaged at the ends of the second shaft 74. For example, from the outside in, the tether mechanism 22 includes first the fixed end cap 78, then the loop 94 of one tether portion 72, then one or several washers 80, then one side of the ladder 12 (or outer edge of the ladder rung) such that the washers 80 minimize lateral slippage of the loop 94 relative to the ladder 12. From the outside in on the other side of the ladder 12, the tether mechanism 22 includes the removable end cap 76, the loop 94 of the other tether portion 72, the washers 80 and then the other side of the ladder 12 (or outer edge of the ladder rung). Again, the washers 80 minimize lateral slippage of the other loop 94 relative to the ladder 12. Washers 80 are of a sufficiently great size so as not to slip into the inside of the rungs of the ladder 12. Washers 80 pinch loop 94 between themselves and the respective end cap 76 or 78.

As to the ratchet mechanism 70, the following U.S. Patents are hereby incorporated by reference in their entireties: the Huber U.S. Pat. No. 3,718,315 issued Feb. 27, 1973 and entitled Strap Adjuster Devices and the Bronson et al. U.S. Pat. No. 4,155,537 issued May 22, 1979 and entitled Adjustable Length Strap Tie Down Apparatus.

Figure 9:
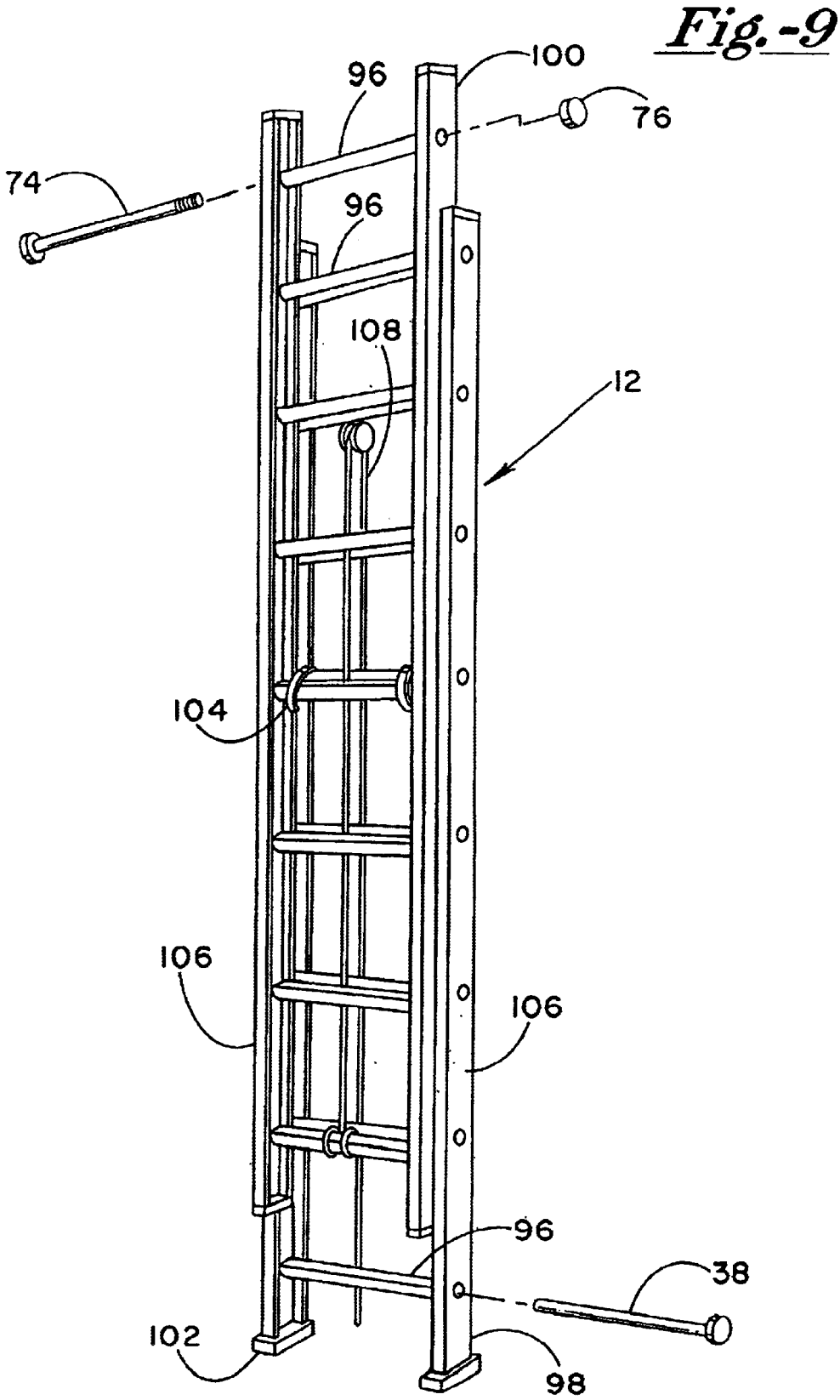
FIG. 9 is a perspective view of an extension ladder, a removable shaft of the adapter of FIG. 2 wherein the removable shaft is engageable to a bottom portion of the extension ladder, and an adapter peripheral (a removable rod) for the upper portion of the extension ladder.

FIG. 9 shows the ladder 12 in relation to the first and second removable shafts 38 and 74. Ladder 12 includes rungs 96. Each of the rungs 96 is tubular or hollow such that the first and second removable shafts 38 and 74 may be slid into any of the rungs 96. When in their respective rungs 96, shafts 38 and 74 are pivotable such that the angle of the ladder 12 relative to the adapter 20 may be changed, and such that the angle of the tether 22 relative to the ladder 12 may be changed. The ladder 12 is an extension ladder having a first lower extension portion 98 and a second upper extension portion 100. The ladder 12 further includes feet or shoe rests 102 that may make contact with base plate 26 and/or oblique plate 30, spring loaded locks 104 to prevent the upper portion 100 from slipping down, sides or side rails 106, and a pulley mechanism 108 for extension of the upper portion 100 or for slowly permitting retraction of the upper portion 100 into the lower portion 98 of the ladder 12. It should be noted that the pulley mechanism 108 can be operated while the first and second removable shafts 38 and 74 are engaged in their respective ladder rungs 96 and while the tether mechanism 22 is engaged to and between the vehicle 14 and the upper end of the ladder 12.

Figure 10:
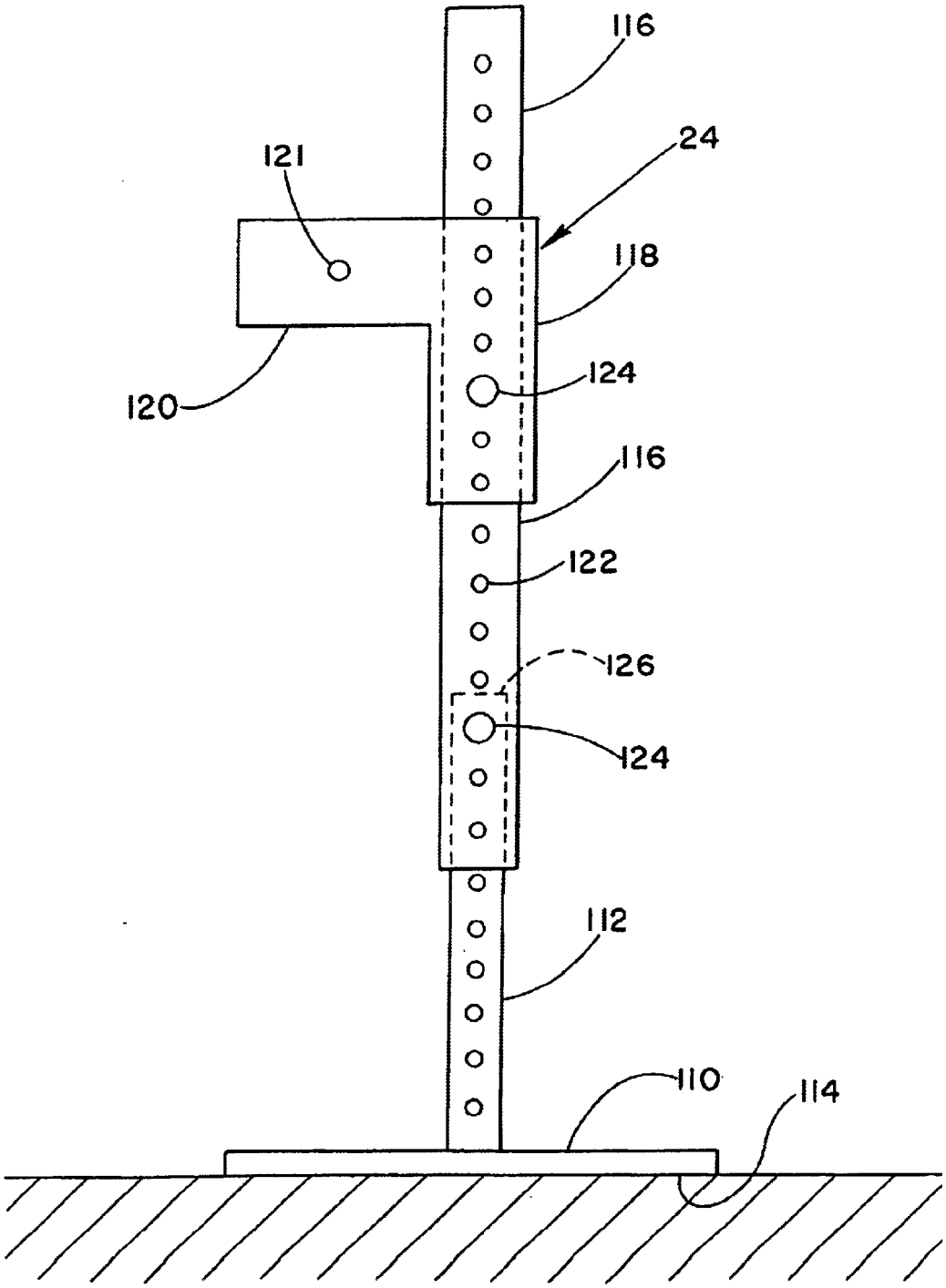
FIG. 10 is a side view of leg for the adapter of FIG. 2.

FIG. 10 shows the leg 24. Leg 24 includes a base 110 having a first upright telescoping portion 112. Base 110 is relatively wide and includes a relatively great surface area on its bottom face 114 so as to bring pressure to bear over a relatively great amount of the ground, whether the ground is grass and soil, concrete, asphalt, gravel, bricks or some other surface. Leg 24 further includes a second upright telescoping portion 116 that slides over telescoping portion 112. Leg 24 includes a third telescoping portion 118 that slides over telescoping portion 116 and that includes a rigid extension 120. Rigid extension 120 is square in section and fits into opening 52 (shown in FIG. 3). Extension 120 includes a sufficient elongate length to be positioned immediately under the first removable shaft 38 and is sized such that its outer square shaped surface confront closely the inner square shaped surface of beam 34 to prevent any rotation or spinning of the adapter 20 relative to the leg 24. Extension 120 includes an aperture 121 for cooperating with aperture 59 (shown in FIGS. 5 and 6). A pin inserted into such aligned apertures fixes the adapter 20 to the leg 24. Telescoping portions 112, 116 and 118 have cooperating apertures 122 through which pins 124 such that the leg 24 may be lengthened or shortened depending upon the height of the ground underneath the adapter 20 relative to the vehicle 14. Reference number 126 represents the upper end of the lower telescoping portion 112. However, if desired, the lower telescoping portion 112 may extend the entire height or more of telescoping portion 116. Telescoping portions 116 and 118 are tubular. Telescoping portion 112 is preferably tubular. It should be noted that, if telescoping portion 112 runs the entire height of telescoping portion 116, then telescoping portion 116 may be eliminated. However, three telescoping portions 112, 116 and 118 are preferred such that height adjustment of the leg 24 may be made at either end of the leg 24, i.e., between telescoping portions 116 and 112 or between telescoping portions 116 and 118.

Figure 11:
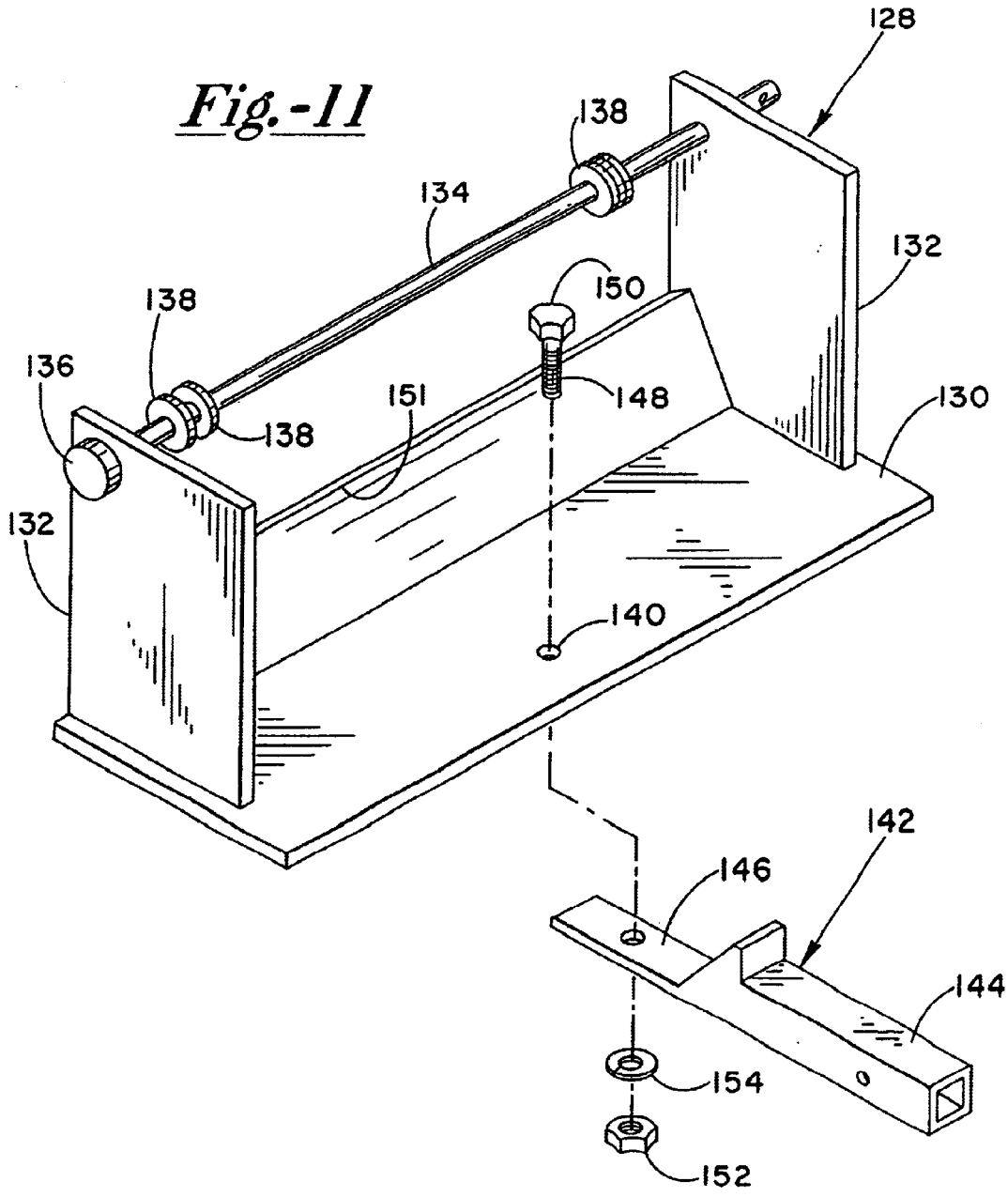
FIG. 11 is a perspective view of an alternate embodiment of the adapter.

FIG. 11 shows an alternate embodiment of the present invention. Here, an adapter 128 includes a base plate 130, upright support plates 132, a first removable shaft 134 mounted to and between the upright support plates 132, a fixed end cap 136 (and a removable pin at the other end of the shaft 134), and washers 138 for minimizing lateral slippage of the ladder 12. Further, adapter 128 includes a hitch aperture 140 located centrally in the base plate 130 and equidistant between the upright support plates 132. Via the hitch aperture 140, the adapter 128 is mounted to a ball hitch 142. Ball hitch 142 includes a tubular frame portion 144 for mating with the hitch 16 of the vehicle 14 (shown in FIG. 1) and a base frame portion 146 for releasably securing a bolt 148 having a head 150. It should be noted that, if desired, adapter 128 may include a transversely extending oblique plate 151 identical to plate 30 of adapter 20. To attach this embodiment, bolt 148 is removed from its base frame portion 146, then aperture 140 and the adapter 128 is oriented relative to the hitch 142 so that the base plate 130 lies on base frame portion 146 of the ball hitch 142, and then the bolt 148 is slid through aperture 140 and anchored to base frame portion 146 with a nut 152 and lock washer 154.

In operation, the vehicle 14 is driven to the intended location. Then the adapter 20 is engaged to the hitch 16. Then the leg 24 is engaged to the adapter 20 and the telescoping portions 112, 114 and 116 are adjusted so as to set the base 114 of the leg 24 firmly against the ground. Then the bottom end of the ladder 12 is connected to the adapter 20, with the ladder 12 lying on the ground and extending away from the bed 18 of the truck 14. The ladder 12, if an extension ladder, may be in its most retracted position. Then the second shaft 74 is engaged to the upper end of the ladder 12 along with the tether portions 72 and the posts 62 are engaged to the truck eyelets 60. Then the tethers 68 are lengthened to as to extend the length between the truck eyelets 60 and the upper end of the ladder 12 when the ladder 12 is lying on the ground away from the bed of the truck 14.

Then the clips 82 of the tethers 68 are clipped to the truck eyelets 60 and to the loops 88 of the tether portions 72. Then the ratchet mechanisms 70 are operated to draw the ladder 12 upwardly from its prone position to its operating, inclined position, such as the position shown in FIG. 1.

After the ladder 12 is in its operating position such as shown in FIG. 1, a user may use the pulley mechanism 108 to pull out the upper portion 100 of the ladder 12 and thereby extend the ladder 12. A user may also lengthen or shorten the tethers 68. When the tethers 68 are lengthened or shortened, the upper end of the ladder 12 is raised or lowered and the angle of the ladder 12 relative to the ground changes. When the pulley mechanism 108 is operated, the upper end of the ladder 12 is raised or lowered. Accordingly, utilizing a combination of adjustments of the pulley mechanism 108 and the tether mechanism 22, the desired height and position of the upper end of the ladder 12 may be obtained. Further, the vehicle 12 may be driven forwardly or rearwardly for short distances with the base 114 slightly elevated and with the ladder 12 in an operating position as shown in FIG. 1.

After the ladder 12 is in its operating position and the upper end of the ladder 12 is adjacent the desired work location, a user may climb the rungs 96 of the ladder 12. When the user climbs, the ladder 12 does not spin or rotate, due to the connection between the adapter 20 and the hitch 16. Nor does the ladder 12 slide laterally relative to the adapter 20. Nor does the ladder 12 fall, due to the tether mechanism 22 and the internal locks of the ratchet mechanism 70. As the user reaches the top of the ladder 12, the weight of the user may tend to act as a lever to drive the front end of the vehicle 14 upwardly, but such a force is countered and minimized by the leg 24, which prevents the rear end of the vehicle 14 from being driven downwardly and thereby prevents the front end of the vehicle 14 from being raised.

During work at the desired elevated location, the user may climb down the ladder 12, adjust the location and height of the upper end of the ladder 12 by using one or both of the tether mechanism 22 and pulley mechanism 108 or by driving the vehicle 14 for short distances, and then climb back up the ladder 12 to work at an adjacent elevated location.

After work at the desired location is complete, the ladder 12 may be taken down by slowly retracting the upper portion 100 of the ladder 12 by using the pulley mechanism 108, then slowly lowering the ladder 12 from its inclined position by utilizing the tether mechanism 22, then removing the tether mechanism 22 from the ladder 12 and vehicle 14, then removing the ladder 12 from the adapter 20, then removing the leg 24 from the adapter 20, then removing the adapter 20 from the hitch 16.

It should be noted that, if desired the tethers 68 may be crisscrossed when connected between the vehicle 14 and the ladder 12 so as to form an "X." Or a "Y" shaped tether may be employed where the base of the "Y" is fixed to the vehicle 12 and operated by a single ratchet mechanism 70. The branches of the "Y" tether are fixed to respective sides of the ladder 12 and the lengthening and shortening of the branches are controlled by the single said ratchet mechanism 70.

It should further be noted that leg 24 may not be required, depending upon the weight of the user, the weight of the vehicle 14, and the length to which the upper portion 100 of the extension ladder 12 is extended.

It should further be noted that the tether mechanism 22 may not be required. For example, the upper end 100 of the extension ladder 12 may be leaned against a side of a house or against a branch of a tree or against another structure.

It should be noted that one end of the tether 68 may be affixed directly to the truck eyelets 60 (without the intermediate pins 62) and the other end of the tether 68 may be affixed directly to the upper end of the ladder 12 or to any other portion of the ladder 12. When so affixed directly to the ladder 12, it is preferably if one tether 68 is wound about one side rail 106 and a rung 96 and if the other tether is wound about the other side rail 106 and the same rung 96 to keep the tethers 68 at the same height and to keep the tethers 68 spaced apart. After being wound about the side rail 106 and rung 96, the clip 82 of the tether 68 is clipped to the strap of its own tether 68. Likewise, depending on the size of the clip 82 and the size of the truck eyelet 60, the clip 82 may be pushed into truck eyelet 60 and then out into the bed of the truck 14, whereupon the clip 82 is clipped to the strap of its own tether 68.

The truck eyelets 60 may be referred to as stake pockets 60. As to the pins 62, which may be referred to as tie down anchors, the following U.S. patents are hereby incorporated by reference in their entireties: U.S. Pat. No. 4,812,093 issued Mar. 14, 1989 to Millar, Jr. and entitled Stake Pocket Tie-Down Anchor and U.S. Pat. No. 4,607,991 issued Aug. 26, 1986 to Porter and entitled Tie-Down Anchor For Truck Bed.

It should further be noted that base 110 of leg 24 may have less surface area (i.e., have a smaller size). For example, base 110 may be square in shape and its side edges may be about one-half the length between upright support plates 28. Or for example, each of the side edges of the base 110 may measure from about six inches to about 12 inches to about 18 inches. If a relatively small base is used, dimensional lumber may be slipped under the base 110 to keep the rear end of the vehicle 14 from pressing the base 110 into soft ground.

The present invention includes an adapter 20, wherein the adapter 20 is adaptable for mounting a ladder 12 in a functional position on a vehicle 14, wherein the vehicle 14 has a hitch 16, wherein the ladder 12 has first and second end portions and tubular rungs 96 at the first and second end portions. The adapter 20 includes: a) a frame engageable to the hitch 16 and includes a base portion 26 and a pair of support portions 28, wherein the support portions 28 extend transversely of the base portion 26, wherein the frame includes a front and a rear, wherein the front of the frame faces the vehicle 14 and the rear of the frame faces an object to be climbed up to on the ladder 12; and b) a shaft 38 engageable to and between the support portions 28 and being spaced from the base portion 26, wherein the shaft 38 is sized to extend through the tubular rung 96 of the first end portion of the ladder 12, wherein the shaft 38 provides an axis of rotation about which the ladder 12 rotates in first and second rotational directions; c) wherein the frame is engaged to the hitch 16 and wherein the shaft 38 is slid into the tubular rung 96 on the first end portion of the ladder 12 to mount the ladder 12 in a functional position to the vehicle 14; d) wherein the frame further comprises a stop 30, wherein the stop 30 prevents the first end portion of the ladder 12 from being rotated beyond the stop 30 in the first rotational direction, wherein the stop 30 is positioned immediately below the shaft 38, wherein the stop 30 is positioned to permit the ladder 12 to be placed in a prone position where the second end portion is disposed beyond the rear of the frame, wherein the stop 30 is positioned to permit to permit the ladder 12 to be drawn from said prone position up to an operating, inclined position, and wherein the stop 30 is positioned to discourage the ladder 12 from being set up perpendicular to the ground. The adapter 20 further includes the stop 30 fixed between the support portions 28 and obliquely relative to the base portion 26. The adapter 20 further includes the tether mechanism 22 for controlling rotation of the ladder 12 in the second rotational direction. The adapter further includes the shaft 74 having two end portions.

The present invention further includes an adapter 20, wherein the adapter 20 is adaptable for mounting a ladder 12 in a functional position on a vehicle 14, wherein the vehicle 14 has a hitch 16, wherein the ladder 12 has first and second end portions. The adapter 20 includes: a) a frame engageable between the hitch 16 and the ladder 12 and for supporting the ladder 12 in a functional position and permitting a swinging of the ladder 12 about an axis of rotation about which the ladder 12 rotates in first and second rotational directions, wherein the frame includes a front and a rear, wherein the front of the frame faces the vehicle 14 and the rear of the frame faces an object to be climbed up to on the ladder 12; b) a stop 30 engaged to the frame, wherein the stop prevents the first end portion of the ladder 12 from being rotated beyond the stop 30 in the first rotational direction, wherein the stop 30 is positioned below the axis of rotation, wherein the stop 30 is positioned to permit the ladder 12 to be placed in a prone position where the second end portion of the ladder 12 is disposed beyond the rear of the frame, wherein the stop 30 is positioned to permit the ladder 12 to be drawn up from said prone position to an operating, inclined position; and c) a tether 22 engagable between the vehicle 14 and the ladder 12 to control the second end portion of the ladder 12, wherein the tether 22 controls a rotation of the ladder 12 in the second rotational direction; d) such that each of the first and second rotational directions is controlled and such that each of the end portions of the ladder 12 is controlled.

Figure 12:
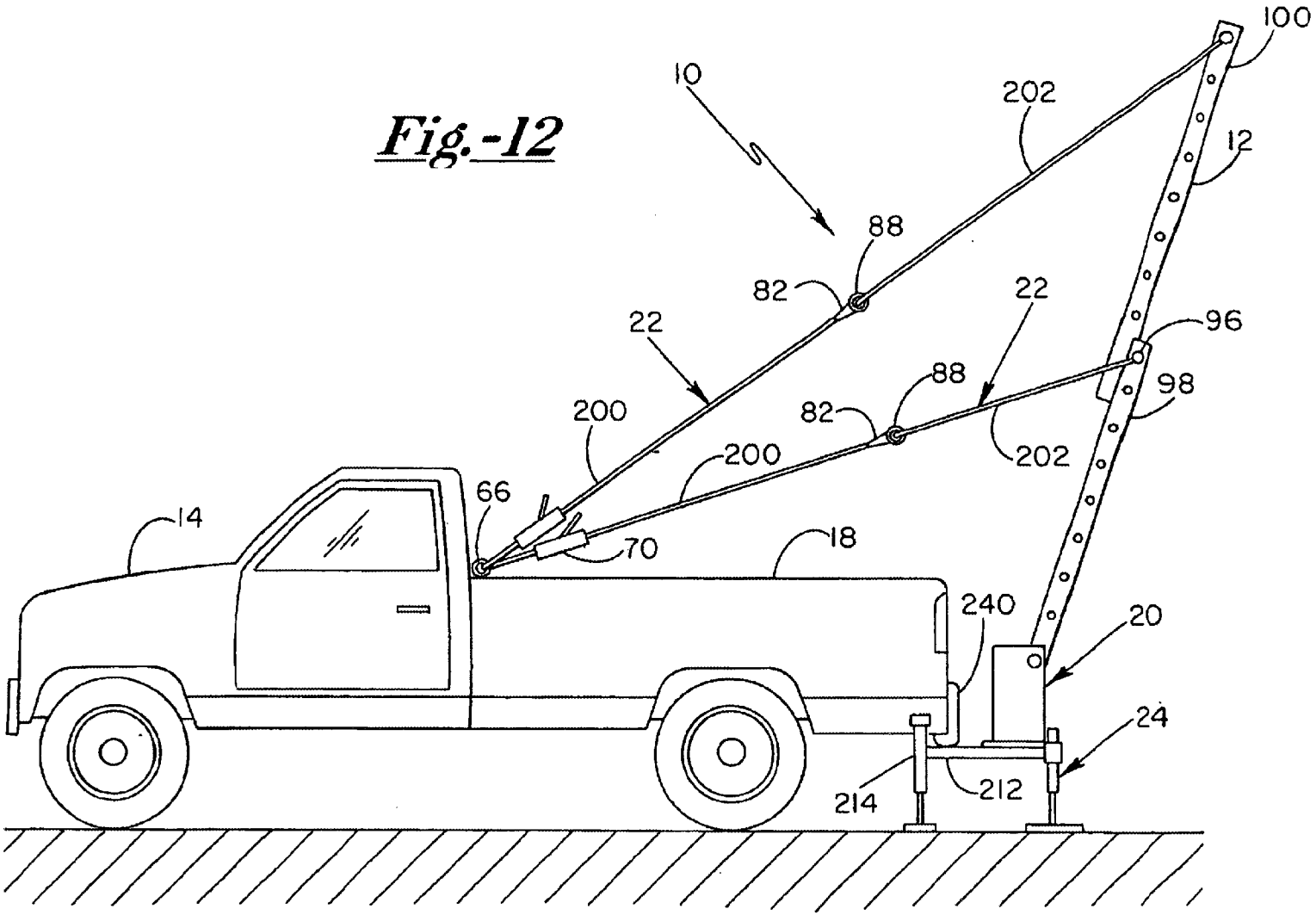
FIG. 12 shows an side view of an improvement to my invention wherein a first or base tether is engaged to a first or base portion of the ladder and wherein a second or upper tether is engaged to a second or upper portion of the ladder.

FIG. 12 shows an side view of an improvement to my invention wherein a first or base or lower tether 22 is engaged to an upper section of the first or base or lower extension portion 98 of the ladder 12 and wherein the second or upper tether 22 is engaged to an upper section of the second or upper extension portion 100 of the ladder 12. Like the upper tether 22, the base tether 22 is engaged at one end to truck eyelets 60. However, at the other end, base tether 22 is engaged to an upper section of the first or base portion 98 of ladder 12. More specifically base tether 22 is engaged to an upper rung 96 of the base portion 98. Accordingly, ladder 12 is preferably stabilized with four tethers 22 wherein one base tether 22 runs from the right side of the vehicle 14 to the right side of ladder base portion 98, wherein the other base tether 22 runs from the left side of the vehicle 14 to the left side of ladder base portion 98, wherein one upper tether 22 runs from the right side of the vehicle 14 to the right side of ladder upper portion 100, and wherein the other upper tether 22 runs from the left side of the vehicle 14 to the left side of ladder upper portion 100. It should be noted that ladder upper portion 100 slides relative to ladder lower portion 98 and that the ladder portions 98, 100 may slide relative to each other while the tethers 22 are connected to each of the ladder portions 98, 100.

In operation, it is preferred that each of the upper and lower tethers 22 are first connected to their ladder portions 98, 100 while ladder upper portion 100 is fully retracted in ladder lower portion 98. In such a retracted position, lower tether 22 may be fully tightened via the ratchet mechanism 70. In such a retracted position, upper tether 22 is engaged between truck eyelet 66 and ladder upper portion 100 such that slack remains in the upper tether 22. Subsequently, ladder upper portion 100 is extended to the desired position, whereupon upper tether 22 is tightened via the ratchet mechanism 70. The steps are reversed to take down the ladder upper portion 100, with a loosening of the upper tether 22 being preferred prior to a sliding of ladder upper portion 100 down into ladder lower portion 98.

An advantage of having a four tether arrangement, wherein two tethers 22 are affixed to the ladder lower portion 98 and the other two tethers 22 are affixed to the ladder upper portion 100, is safety. First, having the ladder lower or base portion 98 stabilized, stabilizes the ladder 12 as a whole. The further connection of upper tether 22 still further stabilizes ladder 12. Second, if one tether 22 breaks or otherwise becomes disengaged, the ladder 12 is less likely to "roll" or twist. In other words, if a left side tether 22 breaks, there is still the other left side tether 22 engaged to the ladder 12 to minimize such rolling or twisting of the ladder 12. It should be noted that even if two left side tethers break, rod 38 minimizes a rolling or twisting of ladder 12.

Each of the tethers 22 may include a first tether portion 200 and a second tether portion 202. First tether portion 200 includes the clip 82 at one end, the clip 82 at the other end to engage truck eyelet 60, and the ratchet mechanism 70 medial of the two ends and two clips 82. Second tether portion 200 includes the loop 88 at one end and the loop 94 at the other end. Each of loop 88 and 94 includes a metallic eye engaged in each of the loops such that metal clip 82 clips onto and engages the metal eye. It should be noted that clip 82 has at minimum a one thousand pound work load and that the web or strap of the tether 22 has at minimum an 800 pound work load.

Lower tether 22 may be affixed to any of the rungs 96 of ladder lower portion 98. However, affixation to the upper rung 96 of ladder lower portion 98 is preferred. Upper tether 22 may be affixed to any of the rungs 96 of ladder upper portion 100. However, affixation to the upper rung 96 of ladder upper portion 100 is preferred.

Figure 13:
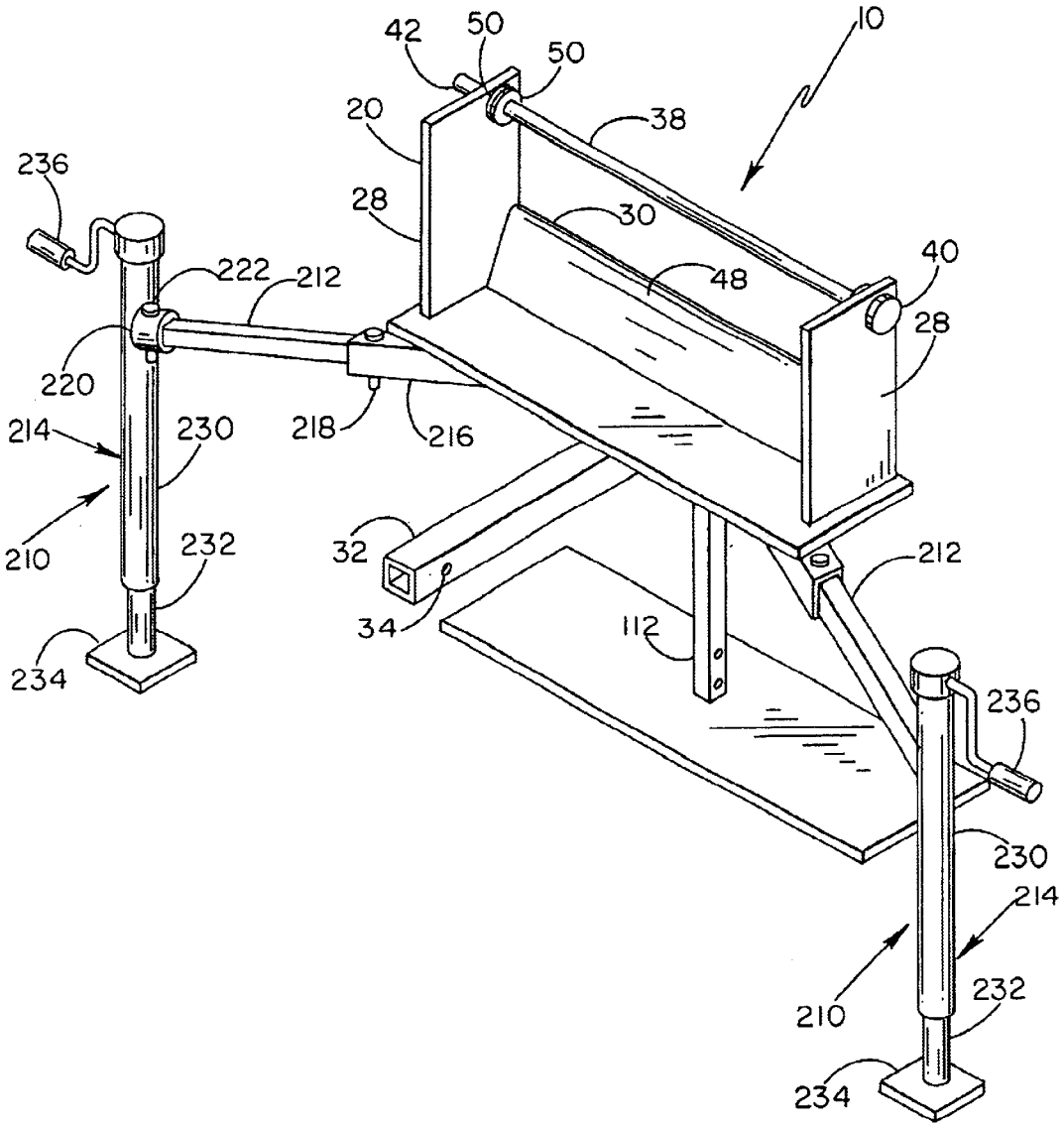
FIG. 13 shows a front perspective of an improvement to my invention having stabilizing legs for the adapter such that the adapter is provided with three points of support.
Figure 14:
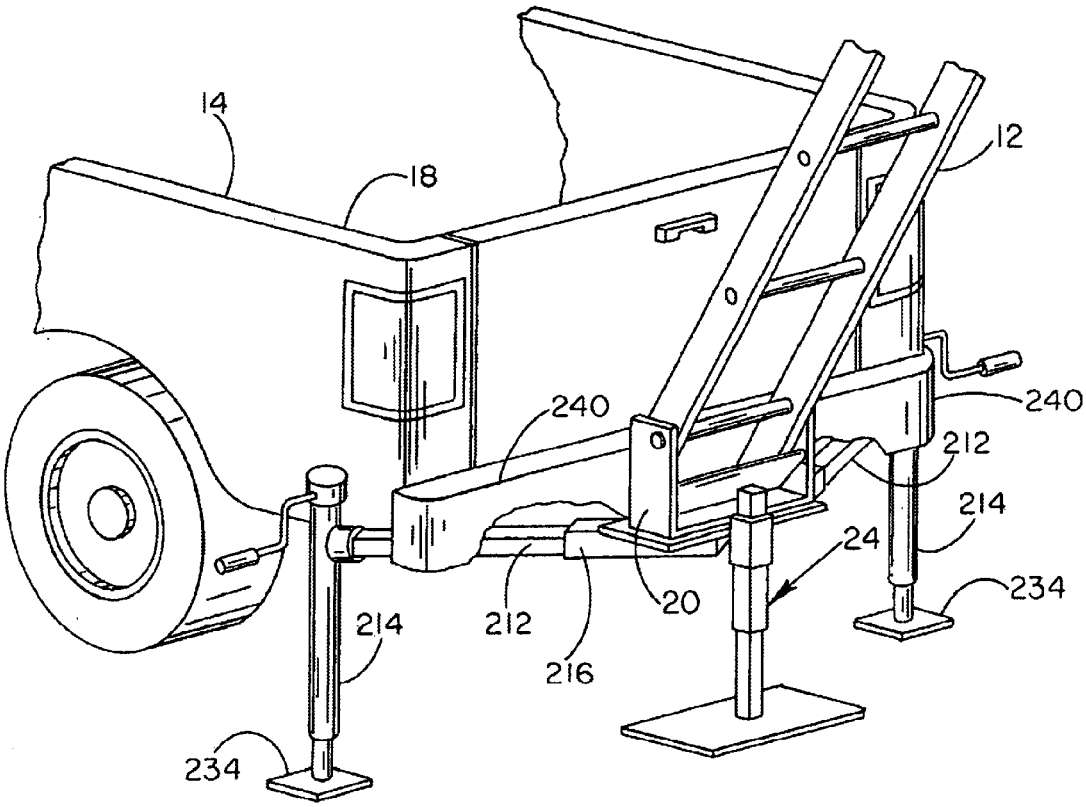
FIG. 14 shows a rear perspective of the improvement of FIG. 13 and shows each of the stabilizing legs bearing a weight of the vehicle.
Figure 15:
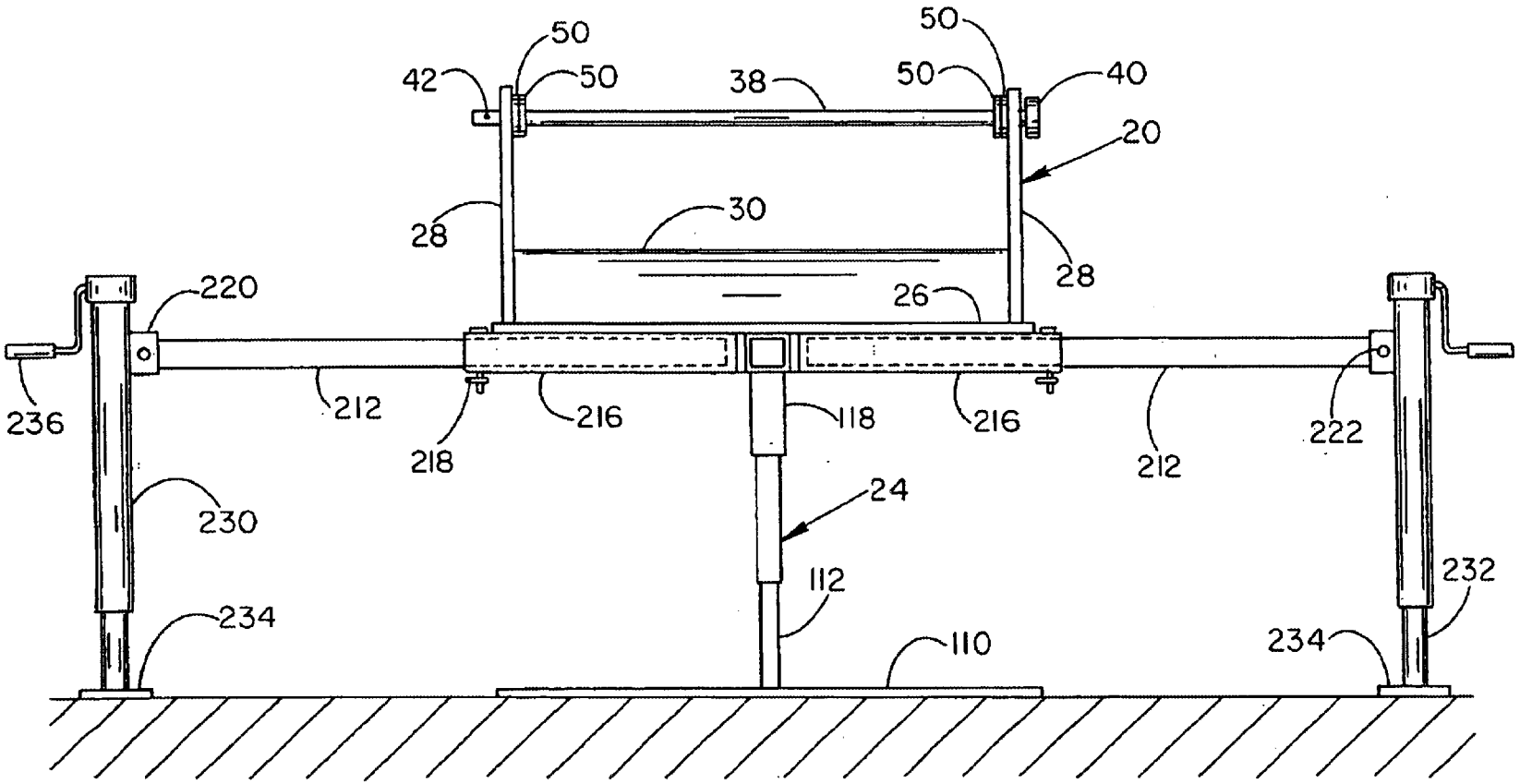
FIG. 15 shows a front view of the improvement of FIG. 13.

FIGS. 13, 14 and 15 show an improvement to my invention wherein the improvement includes a pair of stabilizers 210 for the adapter 20 such that the adapter 20 is provided with a three point arrangement having at least the three points of support, wherein two of the three points of support are the stabilizers 210 and wherein the third point of support is the leg 24 depending from the adapter 20. More specifically, each of the stabilizers 210 includes an arm 212 and a leg 214. Each of the arms 212 is slideably engaged in an oblique tube 216 rigidly fixed obliquely, such as by welding, to the underside of base plate 26. Tubes 216 are obliquely connected to adapter 20 such that arms 212 extend obliquely from and frontwardly of the adapter 20 to rear corners of the vehicle 14. Such obliqueness is relative to the tubular beam 32. Arm 212 may be extended or retracted relative to tube 216 and adapter 20 via removable pins 218 cooperating with apertures in arm 212 and tube 216. At its opposing end, arm 212 is removably engaged to leg 214 via a tube 220 rigidly affixed, such as by welding, to leg 214. Arm 212 slides into tube 220 and is fixed at a position therein via a pin 222. Like with tube 216, arm 212 may be extended or retracted relative to tube 220 such that arm 212 is adjustable in length and such that leg 214 may be spaced to or from the adapter 20 via either of tubes 216 or 220. Further, tube 220 can be lengthened to as to permit a greater amount of extension and retraction.

Leg 214 includes two portions 230 and 232 that are extendable and retractable relative to each other such that leg 214 is adjustable in length. Upper portion 230 is rigidly affixed, such as by welding, to tube 220. Lower portion 232 is engaged to a base 234 for confronting the ground. Leg 214 is a screw jack and extension and retraction of the portions 230, 232 relative to each other is accomplished via a turning of handle 236.

In operation, as shown in FIG. 14, stabilizers 210 lift the rear of the truck 14 ever so slightly to provide support over at least three points for the ladder 12. More specifically, arms 212 are first placed under a bumper 240 or frame portion of vehicle 14, preferably at right and left rear corners of such vehicle 14. Arms 212 are extended or retracted to customize the stabilizer for the vehicle 14. Then handles 236 are turned to ever so slightly raise the rear of the vehicle 14 so that pressure is brought to bear on each of legs 214 and on the third leg 24. It should be noted that support for the ladder 12 may be provided by seven points: one leg 214 bearing a weight of the vehicle 14 and spaced from the adapter 20, the other leg 214 bearing a weight of the vehicle 14 and spaced from the adapter 20, the leg 24 bearing a weight of the vehicle 14 and depending from the adapter 20, and all four of the tires of the vehicle 14 that also bring to bear the weight of the vehicle relative to the ground.

It should be noted that tube 220 is preferably pivotably engaged to leg 214 to permit an upward and forward swinging of leg 214 relative to arm 212. When swung upwardly, legs 214 run generally parallel to beam 32.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

I claim:

1. An adapter, wherein the adapter is adaptable for mounting a ladder in a functional position on a vehicle, wherein the vehicle has a hitch, wherein the ladder is an extension ladder having lower and upper end portions and upper and lower extension portions, wherein each of the upper and lower extension portions have upper sections, wherein the each of the lower and upper extension portions includes a right side and a left side, wherein the adapter comprises:

a) a frame engageable between the hitch and the ladder and for supporting the ladder in a functional position and permitting a swinging of the ladder about an axis of rotation about which the ladder rotates in first and second rotational directions, wherein the frame includes a front and a rear, wherein the front of the frame faces the vehicle and the rear of the frame faces an object to be climbed up to on the ladder, wherein the frame engages the lower end portion of the ladder;

b) a tether arrangement engagable between the vehicle and the ladder to control the upper end portion of the ladder, wherein the tether arrangement controls a rotation of the ladder in the second rotational direction, wherein the tether arrangement comprises:

i) a pair of base tethers extending between the vehicle and the upper section of the lower extension portion of the ladder, wherein one base tether extends to the right side of the upper section of the lower extension portion of the ladder and wherein the other base tether extends to the left side of the upper section of the lower extension portion of the ladder; and ii) a pair of second tethers extending between the vehicle and the upper section of the upper extension portion of the ladder, wherein one second tether extends to the right side of the upper section of the upper extension portion of the ladder and wherein the other second tether extends to the left side of the upper section of the upper extension portion of the ladder;

c) such that the upper end portion of the ladder is controlled and such that each of the lower and upper extension portions of the ladder is controlled and such that if one tether breaks or otherwise becomes disengaged roll of the extension ladder is controlled; and d) a stop engaged to the frame, i) wherein the stop is structured and positioned to prevent the lower end portion of the ladder from being rotated beyond the stop in the first rotational direction such that the first rotational direction is controlled via the stop and such that the second rotational direction is controlled via the tether arrangement;

ii) wherein the stop is structured and positioned to permit the ladder to be placed in a prone position where the upper end portion of the ladder is disposed beyond the rear of the frame and lying on the ground;

iii) wherein the stop is structured and positioned to permit the upper end portion of the ladder to swing up from said prone position to an operating, inclined position; and iv) wherein the stop is structured and positioned to prevent the upper end portion of the ladder from swinging from said operating, inclined position to a position perpendicular to the ground.

2. An adapter in combination with a vehicle, wherein the adapter is adaptable for mounting a ladder in a functional position on the vehicle, wherein the vehicle includes a hitch, wherein the ladder includes first and second end portions, wherein the adapter comprises:

a) a frame engageable between the hitch and the ladder and for supporting the ladder in a functional position and permitting a swinging of the ladder about an axis of rotation about which the ladder rotates in first and second rotational directions, wherein the frame includes a front and a rear, wherein the front of the frame faces the vehicle and the rear of the frame faces an object to be climbed up to on the ladder, wherein the frame engages the first end portion of the ladder; and b) a three-point arrangement for stabilizing the frame, wherein the three-point arrangement comprises:

i) a first leg depending from the frame for confronting the ground;

ii) second and third legs spaced from the frame for confronting the ground, wherein each of the second and third legs are engaged to the frame via an arm extending obliquely from the frame and toward the front of the frame whereby the arms may be positioned to engage the vehicle;

iii) wherein the vehicle includes a rear corner portion and wherein one of the arm is disposed underneath the rear corner portion;

iv) wherein the vehicle includes another rear corner portion and wherein the other arm is disposed underneath said another rear corner portion;

v) wherein the second leg can be extended to bring a weight of the vehicle on the second leg; and vi) wherein the third leg can be extended to bring a weight of the vehicle on the third leg.

3. The adapter according to claim 2, wherein each of the arms is adjustable in length.

4. The adapter according to claim 2 and further comprising a stop engaged to the frame, wherein the stop prevents the first end portion of the ladder from being rotated beyond the stop in the first rotational direction such that the first rotational direction is controlled.

5. The adapter according to claim 2 and further comprising a tether engaged between the vehicle and the ladder for controlling the second rotational direction of the ladder.

6. A method for stabilizing an adapter, wherein the adapter is adaptable for mounting a ladder in a functional position on a vehicle, wherein the vehicle has a hitch, wherein the ladder has first and second end portions, wherein the adapter comprises: a) a frame engageable between the hitch and the ladder and for supporting the ladder in a functional position and permitting a swinging of the ladder about an axis of rotation about which the ladder rotates in first and second rotational directions, wherein the frame includes a front and a rear, wherein the front of the frame faces the vehicle and the rear of the frame faces an object to be climbed up to on the ladder, wherein the frame engages the first end portion of the ladder; and b) a three-point arrangement for stabilizing the frame, wherein the three-point arrangement comprises: i) a first leg depending from the frame for confronting the ground; and ii) second and third legs spaced from the frame for confronting the ground, wherein each of the second and third legs are engaged to the frame via an arm extending obliquely from the frame and toward the front of the frame whereby the arms may be positioned to engage the vehicle, wherein the method comprises the steps of:

a) placing one of the arm underneath a rear corner portion of the vehicle;

b) placing the other arm underneath another rear corner portion of the vehicle;

c) extending the second leg to bring a weight of the vehicle on the second leg; and d) extending the third leg to bring a weight of the vehicle on the third leg.

7. An adapter, wherein the adapter is adaptable for mounting a ladder in a functional position on a vehicle, wherein the vehicle has a hitch, wherein the ladder has first and second end portions and tubular rungs at the first and second end portions, wherein the adapter comprises:

a) a frame adaptable to be engaged to the hitch of the vehicle and comprising a base portion and a pair of support portions, wherein the support portions extend transversely of the base portion, wherein the frame includes a front and a rear, wherein the front of the frame faces the vehicle and the rear of the frame faces an object to be climbed up to on the ladder;

b) a shaft engageable to and between the support portions and being spaced from the base portion, wherein the shaft is sized to extend through the tubular rung of the first end portion of the ladder, wherein the shaft provides an axis of rotation about which the ladder rotates in first and second rotational directions; and c) wherein the frame further comprises a stop, wherein the stop prevents the first end portion of the ladder from being rotated beyond the Stop in the first rotational direction, wherein the stop is positioned between the base portion and the shaft, wherein the stop is positioned to permit the ladder to be placed in a prone position where the second end portion is disposed beyond the rear of the frame, wherein the stop is positioned to permit the ladder to be drawn from said prone position up to an operating, inclined position, wherein the stop is positioned immediately below the shaft to prevent the ladder from being set up perpendicular to the ground, and wherein the stop includes a plate fixed between the support portions and obliquely relative to the base portion.

8. An adapter, wherein the adapter is adaptable for mounting a ladder in a functional position on a vehicle, wherein the vehicle has a hitch, wherein the ladder has lower and upper end portions and tubular rungs at the lower and upper end portions, wherein the adapter comprises:

a) a frame comprising:

i) a tubular piece adapted to be engaged to the hitch of the vehicle;

ii) a base plate engaged to the tubular piece;

iii) a pair of support portions engaged on the base plate; and iv) a front and a rear, wherein the front of the frame faces the vehicle and the rear of the frame faces an object to be climbed up to on the ladder;

b) a shaft engageable to and between the support portions and being spaced from the base plate, wherein the shaft is sized to extend through the tubular rung of the lower end portion of the ladder, wherein the shaft provides an axis of rotation about which the ladder rotates in first and second rotational directions; and c) wherein the frame further comprises a stop fixed to the frame and positioned between the shaft and the base plate, i) wherein the stop is structured and positioned to prevent the lower end portion of the ladder from being rotated beyond the stop in the first rotational direction such that the first rotational direction is controlled;

ii) wherein the stop is structured and positioned to permit the ladder to be placed in a prone position where the upper end portion of the ladder is disposed beyond the rear of the frame and lying on the ground;

iii) wherein the stop is structured and positioned to permit the upper end portion of the ladder to swing up from said prone position to an operating, inclined position; and iv) wherein the stop is structured and positioned to prevent the upper end portion of the ladder from swinging from said operating, inclined position to a position perpendicular to the ground.

9. The adapter according to claim 8, wherein the stop is fixed to and between the support portions.

10. The adapter according to claim 8, wherein the stop is fixed to the base plate.

11. The adapter according to claim 8, wherein the stop is fixed to and between the support portions and is further fixed to the base plate.

12. The adapter according to claim 8, wherein each of the support portions comprises a support plate and wherein the stop is fixed to and between the support plates.

13. The adapter according to claim 8, wherein each of the support portions comprises a support plate and wherein the stop is fixed to the base plate.

14. The adapter according to claim 8, wherein each of the support portions comprises a support plate and wherein the stop comprises a stop plate fixed to and between the support plates and to the base plate.

* * * * *